United States Patent [19]

Arendt et al.

[11] 4,119,147

[45] Oct. 10, 1978

[54] PUMPDOWN SAFETY VALVE

[75] Inventors: Henry P. Arendt; Russell A. Johnston, both of Dallas, Tex.

[73] Assignee: Otis Engineering Corporation, Dallas, Tex.

[21] Appl. No.: 734,110

[22] Filed: Oct. 20, 1976

[51] Int. Cl.[2] ..... E21B 43/12

[52] U.S. Cl. ..... 166/155; 166/315; 166/322

[58] Field of Search ..... 166/152-156, 166/331, 334, 72, 117.5, 214-217, 315, 322

[56] References Cited

U.S. PATENT DOCUMENTS

| | | | |
|---|---|---|---|
| 3,312,283 | 4/1967 | Yetman | 166/117.5 |
| 3,606,926 | 9/1971 | Schwegman | 166/315 |
| 3,727,693 | 4/1973 | Tausch et al. | 166/315 |
| 3,762,471 | 10/1973 | Mott | 166/322 |
| 3,764,176 | 10/1973 | Soulié | 166/153 |
| 4,036,296 | 7/1977 | Mott et al. | 166/322 |
| 4,042,024 | 8/1977 | Mott | 166/243 |
| 4,067,387 | 1/1978 | Mott | 166/322 |

OTHER PUBLICATIONS

Otis Pumpdown Completion Equipment, Technical Information System, 4/23/1976.

*Primary Examiner*—Ernest R. Purser
*Attorney, Agent, or Firm*—Vinson & Elkins

[57] ABSTRACT

Disclosed is a pumpdown, retrievable, subsurface, safety valve for use in a well. The valve comprises a valve section including a valve member to control flow through the well tubing and one or more force exerting sections urging the valve member to a position blocking flow. The valve section and force exerting sections are interconnected. This abstract is neither intended to define the invention of the application which, of course, is measured by the claims, nor is it intended to be limiting as to the scope of the invention in any way.

18 Claims, 7 Drawing Figures

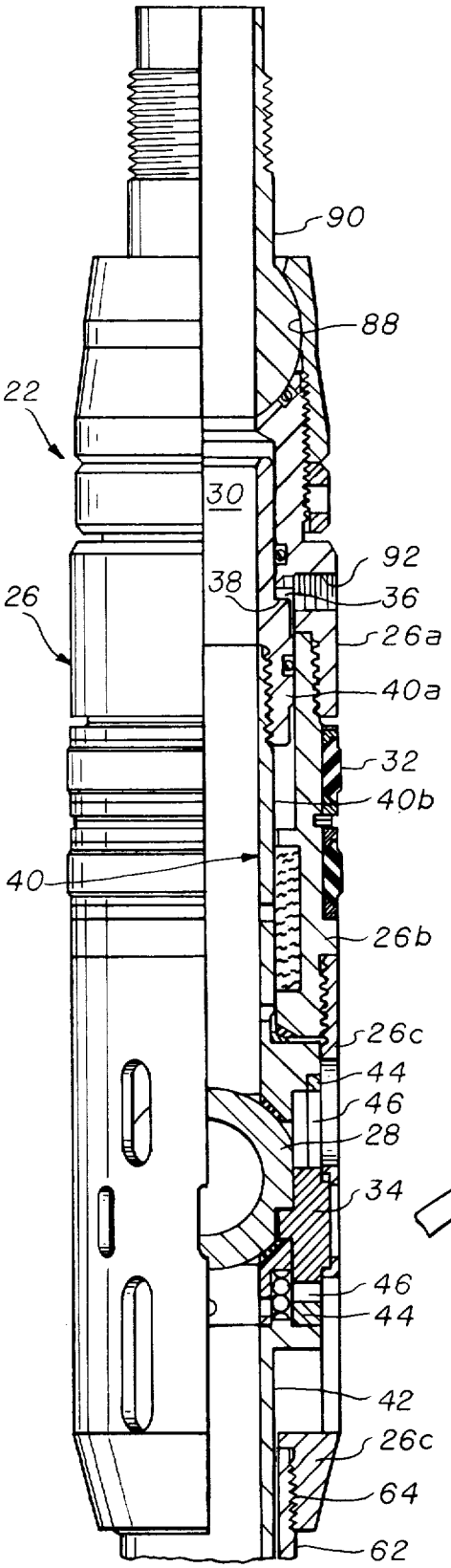
fig. 4
fig. 1
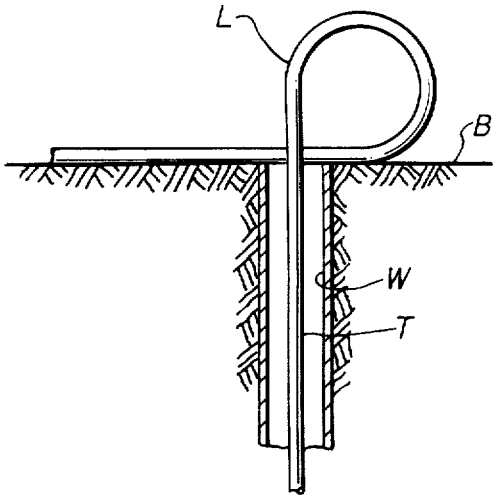
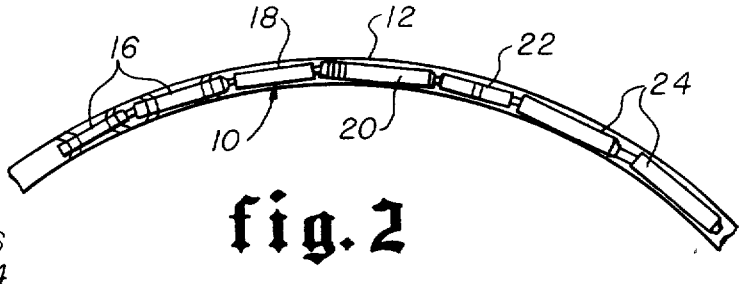
fig. 2

PUMPDOWN SAFETY VALVE

BACKGROUND OF THE INVENTION

1. Field of the Invention

This invention relates to a pumpdown, retrievable, subsurface, safety valve for use in a well.

2. The Prior Art

Subsurface, safety valves have been used in wells for some time. When vertical access to the well is available, subsurface, safety valves are generally installed and retrieved using wireline techniques. However, particularly on offshore wells where vertical access to the well is not practical, pumpdown equipment has been used to install or retrieve a subsurface, safety valve in the well.

Conventional subsurface safety valves have included a valve member movable between positions opening and closing the tubing bore to fluid flow. The valve member generally is adapted to move to a position opening the bore in response to fluid pressure. Biasing means are often provided to urge the valve member to a position closing the bore. For a surface conrolled, subsurface safety valve the baising means must overcome the force of the hydrostatic head of control fluid utilized to pressurize a pressure chamber. Because the force exerted by the hydrostatic head of fluid increases as the depth of the valve increases, the force exerted by the biasing means must also increase as the depth of the valve increases.

Springs are one common source of the biasing force for the biasing means. If the valves can be installed by wireline techniques, the biasing means can include a plurality of springs or one large spring. However, if the valve must be installed by pumpdown techniques, present safety valves have not been able to utilize a long spring or a plurality of springs to create the large force necessary to overcome a large hydrostatic head of fluid. This is because the valve must be pumped around a loop or short radius curvature before entering the well. A long valve simply connot be pumped through such a loop or curvature. Thus, pumpdown surface-controlled subsurface safety valves have been limited to the use of short springs to create the biasing force. Short springs have been unable to generate a sufficient amount of force to overcome the hydrostatic head of fluid for a valve positioned deep in the well.

Dome pressure chambers have also been used to create the biasing force. (See U.S. Pat. No. 3,860,066 to Pearce, et al). However, dome chambers also present problems. The seals of the dome chamber could fail resulting in a loss of pressure in the dome. This loss of dome pressure could render the valve totally inoperative, or worse yet, fail to close it.

The problems of present pumpdown, surface-controlled, subsurface, safety valves may be summarized as follows: because of the limitations on the valve length and the limited force that may be created by a short spring, if a spring is used as the biasing means the valves may only be used at shallow depths in the tubing. If a dome pressure chamber is utilized to generate the biasing force, possible leakage of pressure from the dome chamber results in less reliability and safety for the valve.

An injection, subsurface safety valve has similar problems. The biasing means must overcome the force of the hydrostatic head of fluid in the tubing. If a spring is used as the source of the biasing force, the pumpdown, subsurface injection safety valves have also been limited to the use of short springs with their inherent weakness. The reduced reliability of a dome pressure chamber also limits its use in a subsurface injection safety valve.

U.S. Pat. Nos. 3,891,032 to Tausch and 3,899,025 to Dinning disclose utilizing a ball joint in a pumpdown kickover tool body to allow the body to move through the curved portions of the pumpdown well tubing.

OBJECTS OF THE INVENTION

It is an object of this invention to provide a pumpdown, subsurface, safety valve which includes a high force generating spring biasing means and which can be pumped through a short radius curvature.

Another object of this invention is to provide a pumpdown, subsurface, safety valve which includes a plurality of springs to bais the valve closed and which can be pumped through a short radius curvature.

Another object of this invention is to provide a spring closing subsurface, safety valve for pumpdown operations for greater safety and reliability that can be pumped arcund a short radius curvature.

Another object of this invention is to provide a pumpdown safety valve which permits the use of a plurality of springs to increase the force biasing the valve closed and which may be pumped around a short radius curvature.

It is an object of this invention to provide a pumpdown, retrievable, subsurface, surface-controlled, tubing safety valve which includes a high force generating spring biasing means and which can be pumped through a short radius curvature.

Another object of this invention is to provide a pumpdown, retrievable, subsurface, surface-controlled, tubing safety valve which includes a plurality of springs to bias the valve closed and which can be pumped through a short radius curvature.

Another object of this invention is to provide a spring closing, retrievable, subsurface, surface-controlled, tubing safety valve for pumpdown operations for greater safety and reliability that can be pumped around a short radius curvature.

Another object of this invention is to provide a pumpdown, retrievable, subsurface, surface-controlled, tubing safety valve which permits the use of a plurality of springs to increase the force baising the valve closed and which may be pumped around a short radius curvature.

It is an object of this invention to provide a pumpdown, retrievable, subsurface, injection safety valve which includes a high force generating spring baising means and which can be pumped through a short radius curvature.

Another object of this invention is to provide a pumpdown, retrievable, subsurface, injection safety valve which includes a plurality of springs to bias the valve closed and which can be pumped through a short radius curvature.

Another object of this invention is to provide a spring closing, retrievable, subsurface, injection safety valve for pumpdown operations for greater safety and reliability that can be pumped around a short radius curvature.

Another object of this invention is to provide a pumpdown, retrievable, subsurface, injection safety valve which permits the use of a plurality of springs to increase the force biasing the valve closed and which may be pumped around a short radius curvature.

These and other objects, and features of advantages, of this invention will be apparent from the drawings, the detailed description and the appended claims.

BRIEF DESCRIPTION OF THE DRAWINGS

In the drawings wherein like numerals indicate like parts and wherein illustrative embodiments of this invention are shown:

FIG. 1 is a schematic sectional view illustrating the use of a loop in a production string through which a pumpable tool train, including a safety valve, may be introduced into the well;

FIG. 2 is a sectional view of a portion of a bend in the production tubing illustrating a pumpdown tool train being pumped through the bend;

FIG. 4 is a quarter sectional view of the safety valve of FIGS. 3A and 3B with the valve closed.

DESCRIPTION OF THE PREFERRED EMBODIMENTS

Figure 3A:
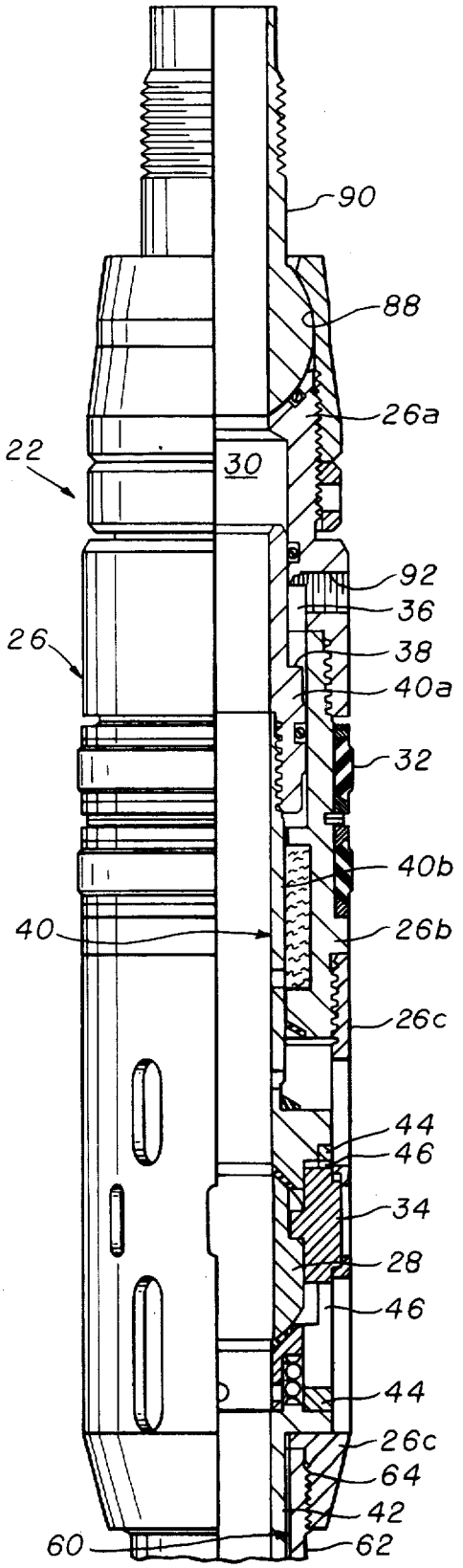
FIGS. 3A and 3B are quarter sectional views in continuation of a safety valve in accordance with this invention with the valve open.

In FIG. 1, a typical oil or gas well W at the bottom B of a body of water is illustrated. The production tubing T extends from a suitable production platform (not shown) along the bottom B, forms a loop L, and extends through the well W. The loop L is suitably supported and has a preselected radius of curvature which permits tool trains, safety valves, and other equipment to be pumped therethrough into the production string T within the well W.

The radius of curvature of the loop L, even though large enough to accommodate most individual tools, is not large enough to accommodate a straight train of tools. Each individual tool in the train is pivotally interconnected with other tools as shown in FIG. 2. The pivotal connecting provides longitudinal flexibility which is standard for use in pumpdown trains. The pumpdown train, generally indicated at 10, in FIG. 2 is within a string 12. Each of the components of the train 10 is pivotally connected to the other components so that the train 10 will easily pass through the spring 12. As shown, the train 10 includes a pair of piston pumpdown locomotives 16, jarring means 18, latching means 20, and a safety valve. The safety valve is divided into a valve section 22 and the spring force exerting sections 24.

Figure 3B:
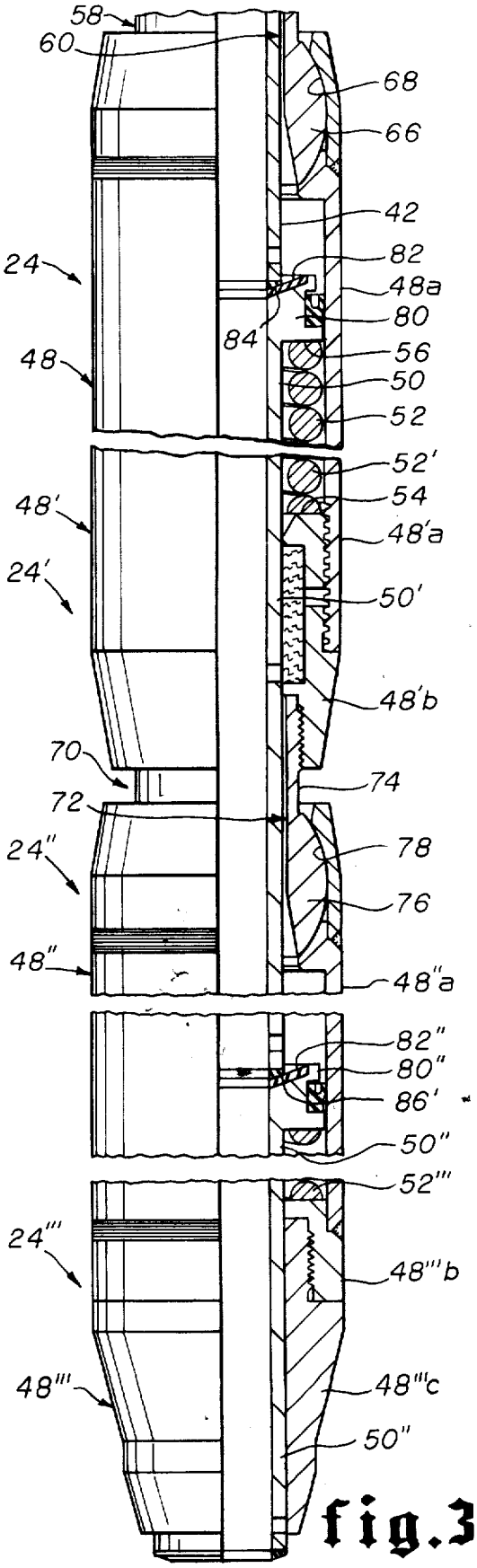

The detail structure of one embodiment of a safety valve is shown in FIGS. 3A, 3B, and 4 with the valve illustrated as if it were landed within a landing nipple (not shown) of the production tubing. This safety valve is a pumpdown, retrievable, surface controlled, subsurface tubing safety valve.

The valve section 22 (see FIG. 3A) comprises valve housing means 26, valve member means 28 and means responsive to control pressure adapted to move valve member means 28.

The valve housing means, generally indicated at 26, makes up one short section of the pumpdown tool train and includes interconnected sections **26*a*, 26*b*, and 26*c*. The valve housing means 26 has a bore 30 through which fluids may flow. Surrounding valve housing means 26 is packer means 32** adapted to seal with the inner wall of the landing nipple (not shown).

Valve member means 28 is positioned within the bore 30 of housing means 24, and is adapted to move between positions opening and closing the bore 30 to permit the block flow through the tubing. The illustrated valve member means 28 is a ball valve member, movable about pin means 34 and is shown opening the bore 30 in FIG. 3A and is shown closing the bore 30 in FIG. 4.

The valve section 22 includes means responsive to control pressure adapted to move valve member means 28 to a position opening the bore 30. This means may include chamber means 36 having a pressure responsive means 38 adapted to move operator means 40. Chamber means 36 is formed between valve housing means 26 and operator means 40. Pressure responsive means 38 is carried by operator means 40, forms a portion of chamber means 36, and is adapted to move operator means 40 when chamber means 36 is pressurized. Operator means, generally indicated at 40, includes interconnected sections **40*a* and 40*b* and engages valve member means 28 to move valve member means 28 to a position opening the bore 30 when the chamber means 36 is pressurized (see FIG. 3A**).

The valve section 22 also includes means adapted to move valve member means 28 to a position closing the bore 30. This valve moving means includes tube means 42 and cage means 44. Tube means 42 transmits the force of the force exerting sections 24 to the valve section 22 so that valve member means 28 can be biased to a position closing the bore 30. Tube means 42 also engages cage means 44 which in turn engages operator means 40. To permit tube means 42 and cage means 44 to move axially within housing means 26 and transmit the force of the force exerting sections 24 to operator means 40, cage means 44 surrounds valve member means 28 and includes slot means 46 to permit movement of cage means 44 around pin means 34.

One or more force exerting sections 24, provide the biasing force tending to move the valve member means 28 to a position closing the bore 30. A plurality of these sections 24 may be interconnected, with one of them connected to the valve section 22, in a manner hereinafter explained, to provide as much biasing force as is desired.

Each force exerting section 24 includes tubular mandrel means 48, movable sleeve means 50, and spring biasing means 52.

The elongate tubular mandrel means, generally indicated at 48, provides another short portion of the valve train 10. It includes interconnected sections **48*a* and 48*b***.

Disposed within tubular mandrel means 48 is sleeve means 50. Sleeve means 50 is adapted to move axially within the mandrel means 48 and functions to transmit the force of spring biasing means 52.

Spring biasing means 52 provides the biasing force of the force exerting section 24 and biases sleeve means 50 to a first, upward position with respect to tubular mandrel means 48. Spring biasing means 52 is disposed between shoulder means 54 of tubular mandrel means 48 and shoulder means 56 of sleeve means 50.

In accordance with this invention swivel connecting means interconnect the valve section 22 and one force exerting section 24. Articulating connecting means interconnect each of the force exerting sections. These connecting means permit the valve section and force exerting sections to be joined into a valve train 10 and pumped through a curvature of the well tubing. Through these connecting means, extend means for permitting the transmission of the spring biasing force generated by the force exerting sections 24 to the valve section 22.

Swivel connecting means, generally indicated at 58, may comprise a universal ball and socket joint. Ball socket means may be formed within the end of either valve housing means 26 or tubular mandrel means 48. Tubular ball member means would then be connected to the end of the other of valve housing means 26 and tubular mandrel means 48 and includes a ball portion adapted to be received within the socket means. Since for a pumpdown tool train it is customary to have all male connections point upwards, the tubular ball member means, generally indicated at 60, includes an upwardly directed tubular stem portion 62 having male threads 64 to connect it to the lower end of housing means 26. The tubular ball member means 60 also includes a ball portion 66 adapted to be received within ball socket means 68 formed within the upper end of tubular mandrel means 48.

Articulating connecting means, generally indicated at 70, is formed like swivel means. It too may comprise a ball and socket joint including a tubular ball member means, generally indicated at 72, having an upwardly directed tubular stem portion 74 threaded into the lower end of one tubular mandrel means 48' and a ball portion 76 adapted to be received within ball socket means 78 formed within the upper end of another tubular mandrel means 48''.

To transmit the force of force exerting section 24 to valve section 22, one of the sleeve means 50 and the tube means 42 extends through swivel connecting means 58 and engages the other of said sleeve means 50 and said tube means 42. Since swivel connecting means 58 permits articulation of the valve section 22 with respect to the force exerting section 24, means are provided to permit the continued engagement of said sleeve means 50 and said tube means 42 during such articulation. Thus, associated with each of said sleeve means 50 and said tube means 42 are means for engaging the other during articulation.

Because of the structual arrangement of the swivel connecting means 58, the transmission of forces from force exerting section 24 to valve section 22 is accomplished by having tube means 42 extend from within valve section 22 through swivel connecting means 58 to within tubular mandrel means 48 where it engages sleeve means 50. The engaging means associated with the sleeve means 50 comprises a flange 80 on the upper end of sleeve means 50 having an upward facing spherical shaped surface 82 which is adapted to be engaged by the lower end of tube means 42. The engaging means of tube means 42 comprises a mating spherical shaped surface 84 on the lower end of tube means 42 adapted to engage sleeve means 50. Preferably, the spherical shaped surface 82 and the mating spherical shaped surface 84 are covered with a material such as polytetrafluoroethylene to minimize friction between them.

Because tube means 42 projects beyond swivel connecting means 58 to within tubular mandrel means 48 to engage sleeve means 50, the transmission of forces from force exerting section 24 to valve section 22 occurs independently of the axial alignment of valve section 22 and force exerting section 24. To assure that tube means 42 and sleeve means 50 are in continued engagement when valve section 22 and force exerting section 24 are not aligned, the centerpoint of spherical shaped surface 82, mating spherical shaped surface 84, and swivel connecting means 58 are substantially the same.

So that when force exerting sections 24 are joined together by articulating connecting means 70, the force of each force exerting section 24 is applied in series to another force exerting section 24 and ultimately to valve section 22, a sleeve means 50 extends through each articulating connecting means 70 to within another force exerting section where it is engaged by another sleeve means. Thus, like tube means 42, one sleeve means 50' extends from within its force exerting section 24' through articulating connecting means 70 to within another force exerting section 24'' where it is engaged by another sleeve means 50''. Associated with each of such sleeve means 50' and 50'' are engaging means such as the upward facing spherical shaped surface 82'' on a flange 80'' of sleeve means 50; and a downward facing mating spherical shaped surface 86 on the lower end of sleeve means 50'. These surfaces may also be covered with polytetraflouroethylene and their centerpoint is also substantially the same as the centerpoint of articulating connecting means 70.

For the lowermost force exerting section 24''', the sleeve means 50''' need not extend beyond the lower end of tubular mandrel means 48'''. However, so that all the sleeve means 50 may be manufactured alike, a lower sub 48'''c may be attached to and form a portion of tubular mandrel means 48''' to protect the lower end of sleeve means 50'''.

With such an arrangement of tube means 42 extending through the swivel connecting means 58 and sleeve means 50 extending through the articulating connecting means 70, the force of each spring biasing means 52 is exerted on the sleeve means 50 of its section and is transmitted through another sleeve means 50 and through tube means 42 to valve section 22. When sleeve means 50 are moved to their first position with respect to tubular mandrel means 48 by spring biasing means 52, tube means 42 has moved operator means 40 to a position wherein valve member means 28 closes the bore 30.

In operation, the valve train 10 including the valve section 22 and at least one force exerting section 24 maybe pumped through a tubing having a curvature and landed in a nipple to provide a subsurface, surface-controlled tubing safety valve. The valve train 10 would also include a latching mandrel (not shown in FIGS. 3A and 3B and FIG. 4) pivotally connected to the upper end of valve section 22 by a universal joint comprising socket means 88 at the upper end of valve housing means 24 and ball member means 90 threaded into the lower end of the latching means 20.

When landed in the landing nipple (not shown) the valve section 22 can be controlled by fluid in a conduit extending from the surface to the landing nipple (not shown). A seal surrounding the latching mandrel will permit pressurized hydraulic control fluid to flow through the conduit port 92 and into chamber means 36. When chamber means 36 is pressurized, valve operator means 40 moves to the position shown in FIG. 3A and moves valve member means 28 to a position opening the bore 30.

When the control pressure is relieved, the force exerted by spring biasing means 52 of the force exerting sections 24 is transmitted through the sleeve means 50 and tube means 42 to move valve member means 28 to a position closing the bore 30 (see FIG. 4). The valve may include as many interconnected force exerting sections 24 as are necessary to exert a force sufficient to overcome the hydrostatic head of fluid present in the control conduit.

Figure 5A:
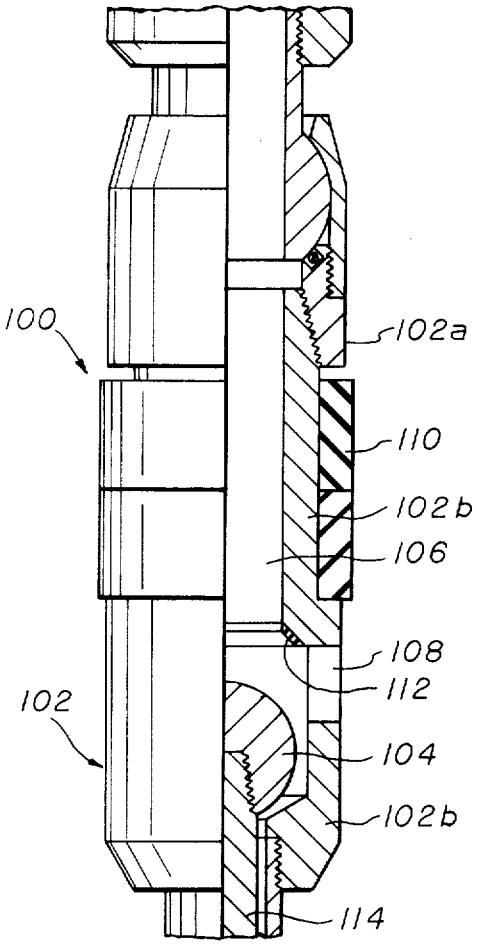
FIGS. 5A and 5B are quarter sectional views in continuation of another safety valve in accordance with this invention with the valve open.
Figure 5B:
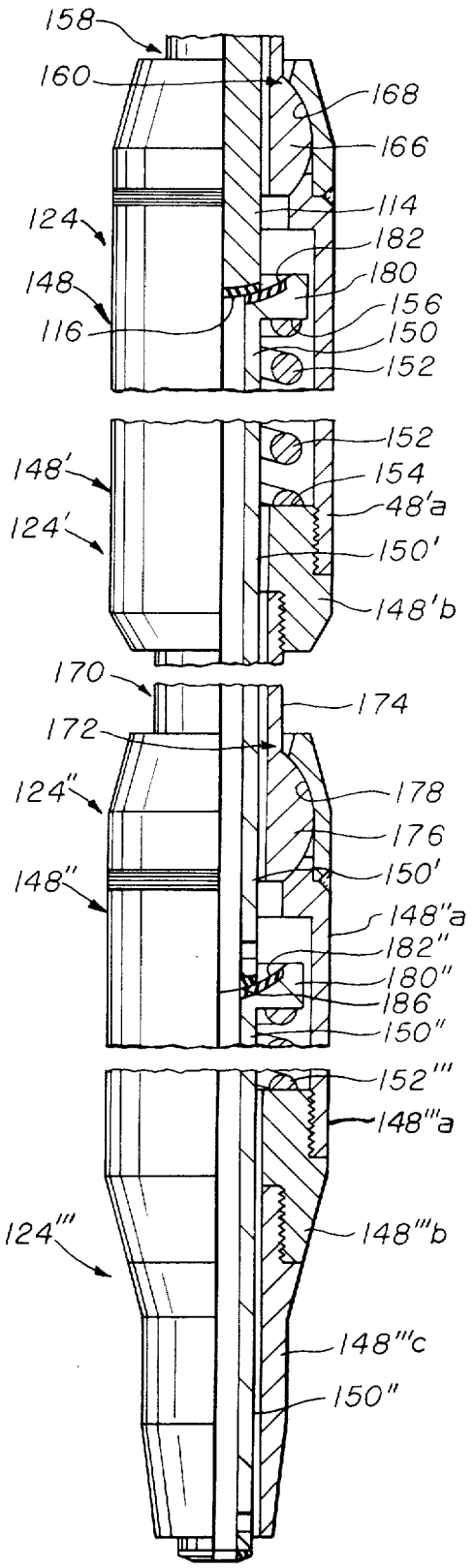

The detailed structure of a second embodiment of a safety valve is shown in FIGS. 5A and 5B, with the valves illustrated as if it were landed within a landing nipple (not shown) of the production tubing. This safety valve is a pumpdown, retrievable, subsurface injection valve. The valve section 100 (see FIG. 5A) comprises valve housing means 102 and valve member means 104.

The valve housing means, generally indicated at 102, makes up on short section of the pumpdown tool train and includes interconnected sections 102*a* and 102*b*. The valve housing means 102 has a bore 106 and port means 108 providing a fluid flow path through the valve section 100. Surrounding the valve housing means 102 is packer means 110 adapted to seal with the inner wall of the landing nipple (not shown).

Valve member means 104 is positioned within valve housing means 102 and is adapted to move longitudinally therein between a position engaging valve seat means 112 to close the flow path and a position removed from valve seat means 112 to open the flow path. Valve member means 104 is moved to its position engaging valve seat means 112 by the force transmitted to the valve section 100 from the force exerting section 124.

The valve may include as many interconnected force exerting sections 124 as is necessary to exert a force sufficient to overcome the hydrostatic head of fluid present within the well tubing.

The force exerting sections 124 are the same as the force exerting sections 24 of the previous embodiment. The various compenents thereof have been designated with numerals that correspond to the numeral designation of the previous embodiments with the addition of the prefix 1.

Swivel connecting means 158 interconnects the valve section 100 and one force exerting section 124. The swivel connecting means 158 is also the same as the swivel connecting means of the previous embodiment and its components have also been designated with numberals which correspond to the designation of the components of the previous embodiment with the addition of the prefix 1.

To transmit the force of the force exerting section 124 to the valve section 100 bar means 114 extends through swivel connecting means 158 to within tubular mandrel means 148 and engages sleeve means 150. Since swivel connecting means 158 permits articulation of the valve section 100 with respect to the force exerting section 124, bar means 114 and sleeve means 150 include engaging means to permit their continued engagement during such articulation. The engaging means associated with bar means 114 comprises a mating spherical shaped surface 116 on the lower end of bar means 114 which is adapted to engage the spherical shaped surface 182 of sleeve means. Preferably, the mating spherical shaped surface 116 is also covered with a material such as polytetrafluoroethylene to minimize the friction between it and spherical shaped surface 182.

The transmission of forces from force exerting section 124 to valve section 100 occurs independent of the axial alignment of valve section 100 and force exerting section 124. To assure that bar means 114, and sleeve means 150 are in continued engagement when the valve section 100 and the force exerting section 124 are not aligned, the centerpoint of spherical shaped surface 182, mating spherical shaped surface 116, and swivel connecting means 158 are substantially the same.

When sleeve means 150 has moved to its first position with respect to tubular mandrel means 148, bar means 114 valve member means 104 to a position engaging valve seat means 112 and closing the valve section flow path.

In operation, after the valve section 100 has been landed in a landing nipple (not shown) the valve controls flow through the tubing bore. When fluid is injected down the tubing bore, the pressure of the injected fluid acting across valve member means 104, moves it away from valved seat means 112 thereby enabling fluid flow through the valve section 100. The force of the injected fluid, necessarily acts against the force transmitted to the valve section 100 from the force exerting sections 124. When injection of fluid is ceased, the force exerted by spring biasing means 152 of the force exerting sections 124 is transmitted to the valve section 100 to move the valve member means 104 to its position engaging valve seat means 112 and closing the flow path. The valve may include as many interconnected force exerting sections 124 as are necessary to exert a force sufficient to overcome the hydrostatic head of fluid present in the well tubing.

From the foregoing it may be seen that the objects of this invention have been attained. A reliable, fail safe, subsurface, safety valve, that may be pumped through a radius of curvature, has been provided. Positive force, exerted by springs, is used to urge the valve member to a position blocking fluid flow. However, the sections of the valve are not long and the valve may be pumped through a loop or tubing having a curve. The sections, including the valve section and one or more force exerting sections, are interconnected by connecting means which permit the train to pass through the curved portion of the tubing. At the same time, the force of springs within the force exerting sections is transmitted through the connecting means at all times to urge the valve member to a closed position.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. A pumpable safety valve for use in a well comprising:

a valve section including:

valve housing means having a bore extending axially therethrough, valve member means mounted in said bore and adapted for movement between positions opening and closing said bore, and means responsive to control pressure adapted to move said valve member means to a position opening said bore;

a force exerting section including:

tubular mandrel means, sleeve means adapted to move axially within said tubular mandrel means, spring biasing means biasing said sleeve means to a first position with respect to said tubular mandrel means;

tube means within said valve housing means adapted to move said valve member means to a position closing said bore;

swivel connecting means connecting said tubular mandrel means and said valve housing means;

one of said sleeve means and said tube means extending through said swivel connecting means to engage the other of said sleeve means and said tube means; and engaging means associated with each of said sleeve means and said tube means to permit engagement of said sleeve means and said tube means during articulation; and said tube means moves said valve member means to a position closing said bore when said sleeve means is in said first position.

2. The safety valve of claim 1 wherein said engaging means associated with said sleeve means includes an upward facing spherical shaped surface adapted to be engaged by said tube means;

said engaging means associated with said tube means includes a downward facing mating spherical shaped surface adapted to be engaged by said sleeve means; and the centerpoint of said engaging means and of said swivel connecting means is substantially the same.

3. The safety valve of claim 1 wherein said swivel connecting means includes:

ball socket means formed within the end of one of said valve housing means and said tubular mandrel means; and tubular ball member means including a tubular stem portion connected to the other end of said valve housing means and said tubular mandrel means and also including a tubular ball portion adapted to be received within said ball socket means.

4. The safety valve of claim 1 wherein said engaging means associated with said sleeve means includes an upward facing spherical shaped surface adapted to be engaged by said tube means;

said engaging means associated with said tube means includes a downward facing mating spherical shaped surface adapted to be engaged by said sleeve means;

said swivel connecting means includes:

ball socket means formed within the end of one of said valve housing means and said tubular mandrel means, and tubular ball member means including a tubular stem portion connected to the end of the other of said valve housing means and said tubular mandrel means and also including a tubular ball portion adapted to be received within said ball socket means; and the centerpoint of said engaging means and of said swivel connecting means is substantially the same.

5. A pumpable safety valve for use in a well comprising:

a valve section including:

valve housing means having a bore extending axially therethrough, valve member means mounted in said bore and adapted for movement between positions opening and closing said bore, and means responsive to control pressure adapted to move said valve member means to a position opening said bore;

a force exerting section including:

tubular mandrel means, sleeve means adapted to move axially within said tubular mandrel means, and spring biasing means biasing said sleeve means to a first position with respect to said tubular mandrel means;

tube means within said valve housing means adapted to move said valve member means to a position closing said bore;

swivel connecting means including:

ball socket means formed within the end of one of said valve housing means and said tubular mandrel means, and tubular ball member means including a tubular stem portion connected to the end of the other of said valve housing means and said tubular mandrel means and including a tubular ball portion adapted to be received within said ball socket means;

one of said sleeve means and said tube means extending through said swivel connecting means to engage the other of said sleeve means and said tube means;

an upper spherical shaped surface on said sleeve means adapted to be engaged by said tube means;

a downward facing mating spherical shaped surface on said tube means adapted to be engaged by said sleeve means;

said spherical shaped surface and said mating spherical shaped surface engaging each other and permitting the articulating engagement of said sleeve means and said tube means;

wherein the centerpoint of said spherical shaped surface and of said mating spherical shaped surfaced, when engaged, is substantially the same as the centerpoint of said swivel connecting means; and wherein said tube means moves valve member means to a position closing said bore when said sleeve means is in said first position.

6. A pumpable safety vale for use in a well comprising:

a valve section including:

valve housing means having a bore extending axially therethrough, valve member means mounted in said bore and adapted for movement between positions opening and closing said bore, and means responsive to control pressure adapted to move said valve member means to a position opening said bore;

a force exerting section including:

tubular mandrel means, sleeve means adapted to move axially within said tubular mandrel means, and spring biasing means biasing said sleeve means to a first position with respect to said tubular mandrel means;

swivel connecting means connecting said tubular mandrel means and said valve housing means;

tube means extending from within said valve housing means through said connecting means to within said tubular mandrel means;

engaging means associated with each of said sleeve means and said tube means to permit the articulating engagement of said sleeve means and said tube means; and said tube means being adapted to move said valve member means to a position closing said bore when said sleeve means is in said first position;

7. The safety valve of claim 6 wherein said engaging means associated with said sleeve means includes an upward facing spherical shaped surface engaged by said tube means;

said engaging means associated with said tube means includes a downward facing mating spherical shaped surface adapted to be engaged by said sleeve means; and the centerpoint of said engaging means and of said swivel connecting means is substantially the same.

8. The safety valve of claim 6 wherein said swivel connecting means includes:

ball socket means formed within the end of one of said valve housing means and said tubular mandrel means; and tubular ball member means including a tubular stem portion connected to the end of the other of said valve housing means and said tubular mandrel means and also including a tubular ball portion adapted to be received within said ball socket means.

9. The safety valve of claim 6 wherein said engaging means associated with said sleeve means includes an upward facing spherical shaped surface adapted to be engaged by said tube means;

said engaging means associated with said tube means includes a downward facing mating spherical shaped surface adapted to be engaged by said sleeve means;

said swivel connecting means includes:

ball socket means formed within the end of one of said valve housing means and said tubular mandrel means, and tubular ball member means including a tubular stem portion to the other of said valve housing means and said mandrel means and also including a tubular ball portion adapted to be received within said ball socket means; and wherein the centerpoint of said engaging means and of said swivel connecting means is substantially the same.

10. A pumpable safety valve for use in a well comprising:

a valve section including:

valve housing means having a bore extending axially therethrough, vale member means mounted in said bore and adapted for movement between positions opening and closing said bore, means responsive to control pressure adapted to move said valve member means to a position opening said bore;

a force exerting section including tubular mandrel means, sleeve means adapted to move axially within said tubular mandrel means, and spring biasing means biasing said sleeve means to a first position with respect to said tubular mandrel means;

swivel connecting means including:

ball socket means formed within the end of one of said valve housing means and said tubular mandrel means, and tubular ball member means including a tubular stem portion connected to the end of the other of said valve housing means and said tubular mandrel means and also including a tubular ball portion adapted to be received within said ball socket means;

tube means extending from within said valve housing means through said swivel connecting means to within said tubular mandrel means;

an upward facing spherical shaped surface on said sleeve means adapted to be engaged by said tube means;

a downward facing mating spherical shaped surface on said tube means adapted to be engaged by said sleeve means;

said spherical shaped surface and said mating spherical shaped surface engaging each other and permitting the articulating engagement of said sleeve means in said sleeve means; and said tube means being adapted to move said valve member means to a position closing said bore when said sleeve means is in said first position.

11. A pumpable safety valve for use in a well comprising:

a valve section including:

valve housing means having a bore extending axially therethrough, valve member means mounted in said bore and adapted for movement between positions opening and closing said bore, and means responsive to control pressure adapted to move said valve member means to a position opening said bore;

a plurality of force exerting sections including:

elongate tubular mandrel means, sleeve means axially movable within said tubular mandrel means, and spring biasing means biasing said sleeve means to a first position with respect to said tubular mandrel means;

swivel connecting means connecting said tubular mandrel means of one of said force exerting sections with said valve housing means;

articulating connecting means connecting each of said tubular mandrel means with another of said tubular mandrel means;

tube means extending from within said valve housing means through said swivel connecting means to within the tubular mandrel means of said one force exerting section;

at least all but one of said sleeve means extending from within its tubular mandrel means through said articulating means to within another tubular mandrel means;

said tube means being adapted to move said valve member means to a position closing said bore when said sleeve means are in a first position; and engaging means associated with each of said sleeve means and said tube means to permit the articulating engagement of both said sleeve means of said one force exerting section and said tube means and said sleeve means with another sleeve means.

12. The safety valve of claim 11 wherein said engaging means associated with each of said sleeve means includes an upward facing spherical shaped surface which is adapted to be engaged by one of said tube means and the lower end of another of said sleeve means;

said engaging means associated with said tube means includes a downward facing mating spherical shaped surface adapted to be engaged by said sleeve means;

said engaging means associated with said sleeve means also includes a downward facing mating spherical shaped surface adapted to be engaged by another of said sleeve means.

13. The safety valve of claim 11 wherein said swivel connecting means includes:

ball socket means formed within the end of one of said valve housing means and said tubular mandrel means;

tubular ball member means including a tubular stem portion connected to the end of the other of said valve housing means and said tubular mandrel means and also including a tubular ball portion adapted to be received within said ball socket means.

14. The safety valve of claim 11 wherein said articulating connecting means includes:

ball socket means formed within the end of one of said tubular mandrel means; and tubular ball member means including a tubular stem portion connected to the end of another of said tubular mandrel means and also including a tubular ball portion adapted to be received within said ball socket means.

15. A pumpable safety valve for use in a well comprising:

a valve section including:

valve housing means having a flow passage extending therethrough;

valve member means movable in said flow passage between positions opening and closing said flow passage;

a force exerting section including:

tubular mandrel means, sleeve means adapted to move axially within said tubular mandrel means, spring biasing means biasing said sleeve means to a first position with respect to said tubular mandrel means;

swivel connecting means connecting said tubular mandrel means and said valve housing means;

bar means extending through said swivel connecting means for engaging said sleeve means and for moving said valve member means to a position closing said flow passage when said sleeve means is in said first position; and engaging means associated with each of said sleeve means and said bar means for permitting continuous engagement of said bar means and said sleeve means during articulation.

16. The safety valve of claim 15 wherein said engaging means associated with said sleeve means includes an upward facing spherical shaped surface adapted to be engaged by said bar means;

said engaging means associated with said bar means includes a downward facing mating spherical shaped surface adapted to be engaged by said sleeve means; and the centerpoint of said engaging means and of said swivel connecting means is substantially the same.

17. The safety valve of claim 15 wherein said swivel connecting means includes:

ball socket means formed within the end of one of said valve housing means and said tubular mandrel means; and tubular ball member means including a tubular stem portion connected to the other end of said valve housing means and said tubular mandrel means and also including a tubular ball portion adapted to be received within said ball socket means.

18. The safety valve of claim 15 wherein said engaging means associated with said sleeve means includes an upward facing spherical shaped surface adapted to be engaged by said bar means;

said engaging means associated with said bar means includes a downward facing mating spherical shaped surface adapted to be engaged by said sleeve means;

said swivel connecting means includes:

ball socket means formed within the end of one of said valve housing means and said tubular mandrel means, tubular ball member means including a tubular stem portion connected to the end of the other of said valve housing means and said tubular mandrel means and also including a tubular ball portion adapted to be received within said ball socket means; and the centerpoint of said engaging means and of said swivel connecting means is substantially the same.

* * * * *